US006671986B2

(12) United States Patent
Reeves

(10) Patent No.: US 6,671,986 B2
(45) Date of Patent: Jan. 6, 2004

(54) MAGNETIC NAME PLATE ASSEMBLY AND CONNECTOR THEREFOR

(75) Inventor: Robert J. Reeves, Attleboro, MA (US)

(73) Assignee: Reeves Company, Inc., Attleboro, MA (US)

( * ) Notice: Subject to any disclaimer, the term of this patent is extended or adjusted under 35 U.S.C. 154(b) by 0 days.

(21) Appl. No.: 10/173,523

(22) Filed: Jun. 18, 2002

(65) Prior Publication Data

US 2002/0152650 A1 Oct. 24, 2002

Related U.S. Application Data

(63) Continuation-in-part of application No. 09/575,756, filed on May 22, 2002, now Pat. No. 6,446,372.

(51) Int. Cl.[7] ..... A44C 3/00
(52) U.S. Cl. ..... 40/1.6; 40/661.01; 40/600
(58) Field of Search ..... 40/600, 661.01, 40/621, 1.6; 335/285

(56) References Cited

U.S. PATENT DOCUMENTS

| | | | | |
|---|---|---|---|---|
| 3,086,268 A | * | 4/1963 | Chaffin, Jr. | 40/621 |
| 4,236,331 A | | 12/1980 | Mattson | |
| 5,283,966 A | | 2/1994 | Rader et al. | |
| 5,369,899 A | | 12/1994 | Reeves | |
| 5,504,976 A | | 4/1996 | Reeves | |
| 6,006,455 A | | 12/1999 | Miller | |

* cited by examiner

*Primary Examiner*—Cassandra H. Davis
(74) *Attorney, Agent, or Firm*—Salter & Michaelson

(57) ABSTRACT

A name plate assembly includes a name plate and a connector which are magnetically attracted to each other, and which are disposed on opposite sides of a piece of clothing during use. The connector includes a first portion which extends beyond an edge of the name plate. In use, the name plate assembly is removed from the garment by a user engaging the first portion and applying a force. The connector then acts as a lever to break the magnetic connection between the name plate and the connector, and the name plate can then be removed.

20 Claims, 15 Drawing Sheets

MAGNETIC NAME PLATE ASSEMBLY AND CONNECTOR THEREFOR

RELATED APPLICATIONS

This application is a continuation-in-part of U.S. Ser. No. 09/575,756 filed on May 22, 2000 now U.S. Pat. No. 6,446,372.

TECHNICAL FIELD

The invention relates generally to a name plate assembly, and more particularly to a name plate assembly which can be easily removed from a garment by utilizing a connector as a lever, without injuring the garment or the user.

BACKGROUND OF RELATED ART

Magnetic name plates for use with clothing are known to the art. Such name plates generally operate by sandwiching a piece of clothing between two plates which are magnetically attracted to each other. For example, U.S. Pat. No. 5,369,899 which was invented by the applicant, discloses a name plate assembly including a flat, generally rectangular name plate (12) for mounting on the outer surface of the user's garment, and a complementary retaining member (14) for mounting on the inner side of the garment. The name plate and retaining member are magnetically received in a face-to-face relation so that the user's garment is sandwiched therebetween. The name plate and the retaining member are provided with inter-engaging elements that interlock with the fabric sandwiched therebetween in order to effectively limit the relative movement of the members relative to each other. In addition, the name plate and retaining member each include a ferrous steel plate (20, 36), respectively. The steel plates are positioned on opposite sides of a magnetic strip (30) in order to substantially increase the magnetic power of the magnetic strip thereby increasing the magnetic holding power between the name plate and the retaining member. While effective in adhering the name plate assembly to a an article of clothing, it can be difficult for a user to remove the assembly from the clothing. This is due in part to the flat, straight nature of the name plate and retaining member, and the superior magnetic holding power of the assembly, both of which require a user to pry the assembly apart in order to release it from engagement with the clothing.

Another magnetic name plate assembly is disclosed in U.S. Pat. No. 4,236,331 to Mattson. Mattson discloses a self-adhering name badge assembly (10) including a pair of separable flat badge panels (11, 12) which are designed to be placed in face-to-face relationship with a piece of clothing clamped therebetween, in order to support the assembly on the clothing. Each panel has a similar construction, including a magnetic core with N and S poles at opposite ends thereof, with the poles of one of the panels in complementary orientation relative to the poles of the other of the panels. The magnetic core and a ferromagnetic plate may be laminated together in order to increase the stiffness of the badge panels. While generally effective, it has been found that the badge panels can become easily detached from each other by simply brushing against the outer panel of the badge assembly, which causes the badge assembly to disengage from the garment.

Therefore, there is needed in the art a name plate assembly which can be effectively secured to a garment without inadvertently coming disengaged, and which is also easy for a user to remove when desired.

SUMMARY

One object of the present invention is to provide a magnetic name plate assembly which securely maintains the name plate to an article of clothing through magnetic attraction, and which can be easily removed from the garment by a user without injuring the garment or the user.

In accordance with one aspect, there is provided a name plate assembly for use on a garment having a name plate and a connector which are magnetically attracted to each other, and which are disposed on opposite sides of a piece of clothing during use such that the clothing is sandwiched therebetween. The name plate assembly is removed from the garment by the user pressing the connector through the fabric, or by otherwise engaging the connector, for example by grasping and pulling on the connector. In this manner, the connector acts as a lever in order to break the magnetic connection between the name plate and the connector so that the name plate assembly may be easily removed from engagement with the article of clothing without excessive force.

In a first embodiment, the connector may preferably be V-shaped and include an indentation on either end of the legs of the "V" in order to receive a magnet therein. However, the connector may also have any of a variety of shapes, provided that a portion of the connector extends beyond an edge of the face and/or back plate during use so that a user may grasp the connector and utilize the connector as a lever to produce a force sufficient to disengage the connector from engagement with the nameplate. Examples of other shapes the connector body may have include, but are not limited to, generally "U-shaped", semi-circular or "arc" shaped", and generally triangular. Regardless of its shape, the connector is preferably made of a conductive material such that the magnets can be held in place within the connector by magnetic attraction, without the need for adhesives or the like. The name plate preferably includes a face plate for displaying indicia, such as a user's name, and a back plate which is adapted to engage the garment and which is placed in a facing relationship to the magnets of the connector. The back plate is preferably made of a magnetically conductive material such that the magnets of the connector are attracted to the back plate in order to hold the name plate assembly to the clothing. In one embodiment, the back plate includes a set of protrusions in order to limit movement of the connector and name plate relative to each other. The protrusions may also provide a guide for proper placement of the connector. Alternately, the back plate may include a recess or raised wall to limit relative movement of the connector and the name plate, and to act as a guide.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

A magnetic name plate assembly 10 for attachment to an article of clothing according to a first embodiment of the present invention is illustrated in FIGS. 1–9. The name plate assembly 10 preferably includes a name plate 12 and a connector 14 which are magnetically attracted to each other, and which are disposed on opposite sides of a piece of clothing during use such that the clothing is sandwiched therebetween.

Figure 1:
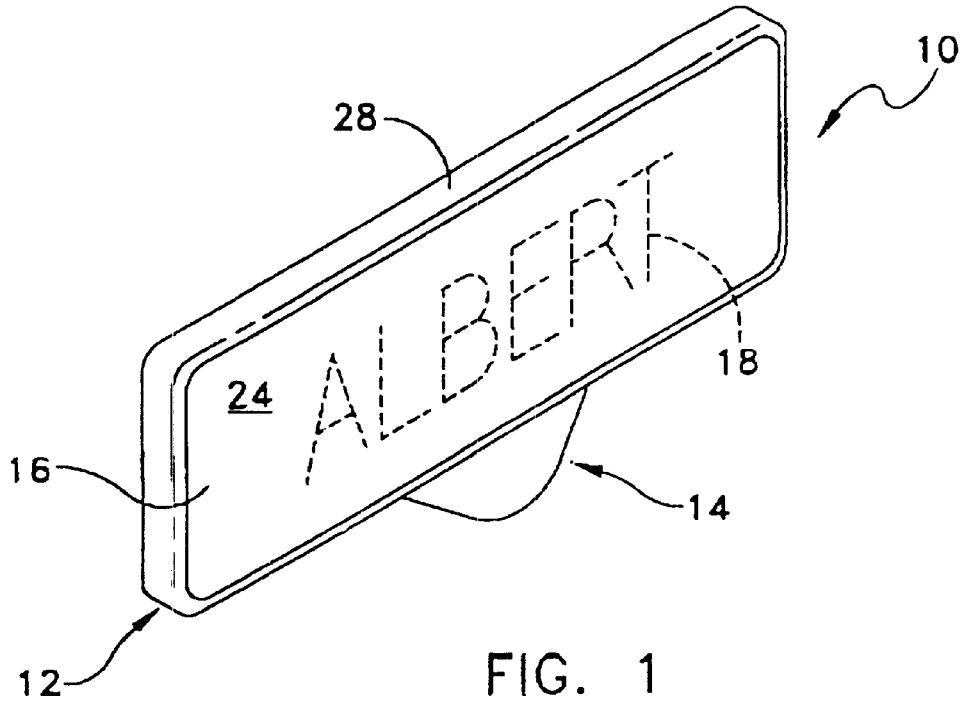
FIG. 1 is a front perspective view showing a magnetic name plate assembly in accordance with a first embodiment of the present invention.
Figure 2:
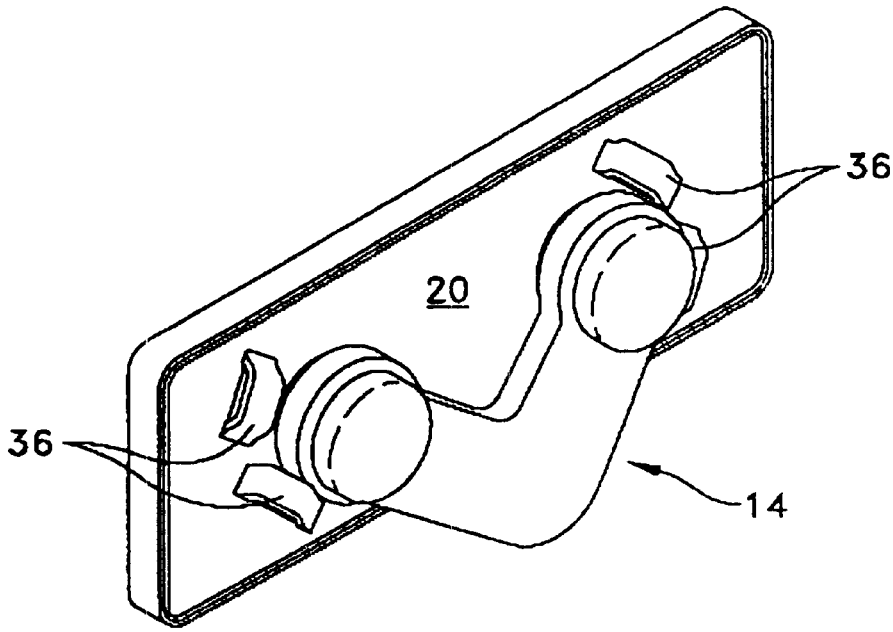
FIG. 2 is a rear perspective view of the name plate assembly of FIG. 1 with the name plate and connector in engagement.
Figure 3:
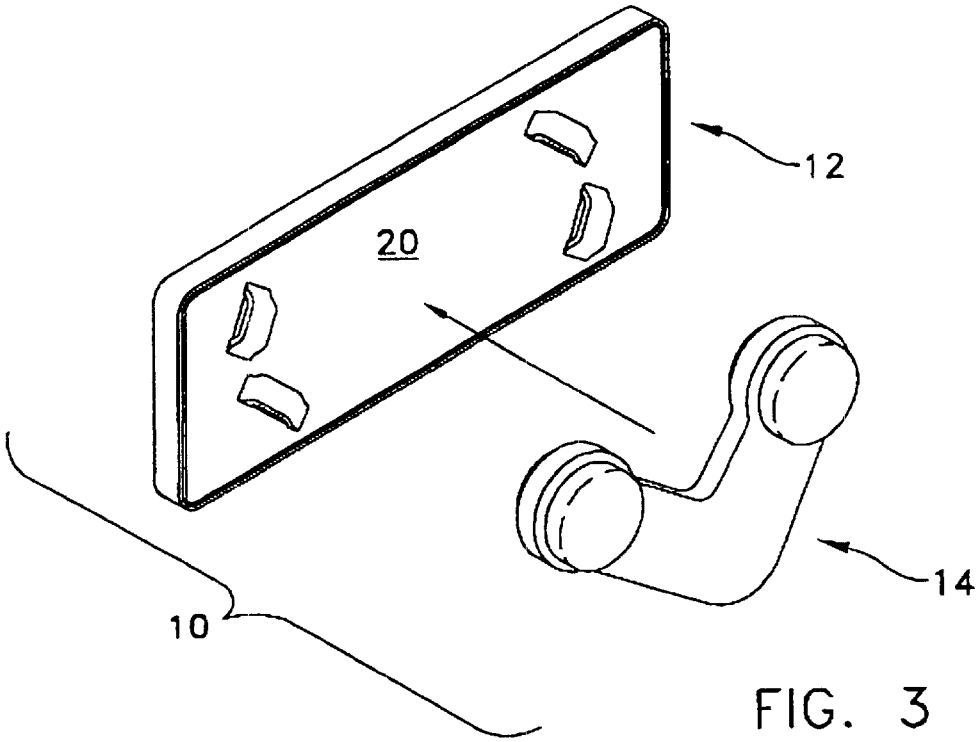
FIG. 3 is a rear view of the name plate assembly of FIG. 1 with the name plate and connector disengaged.
Figure 4:
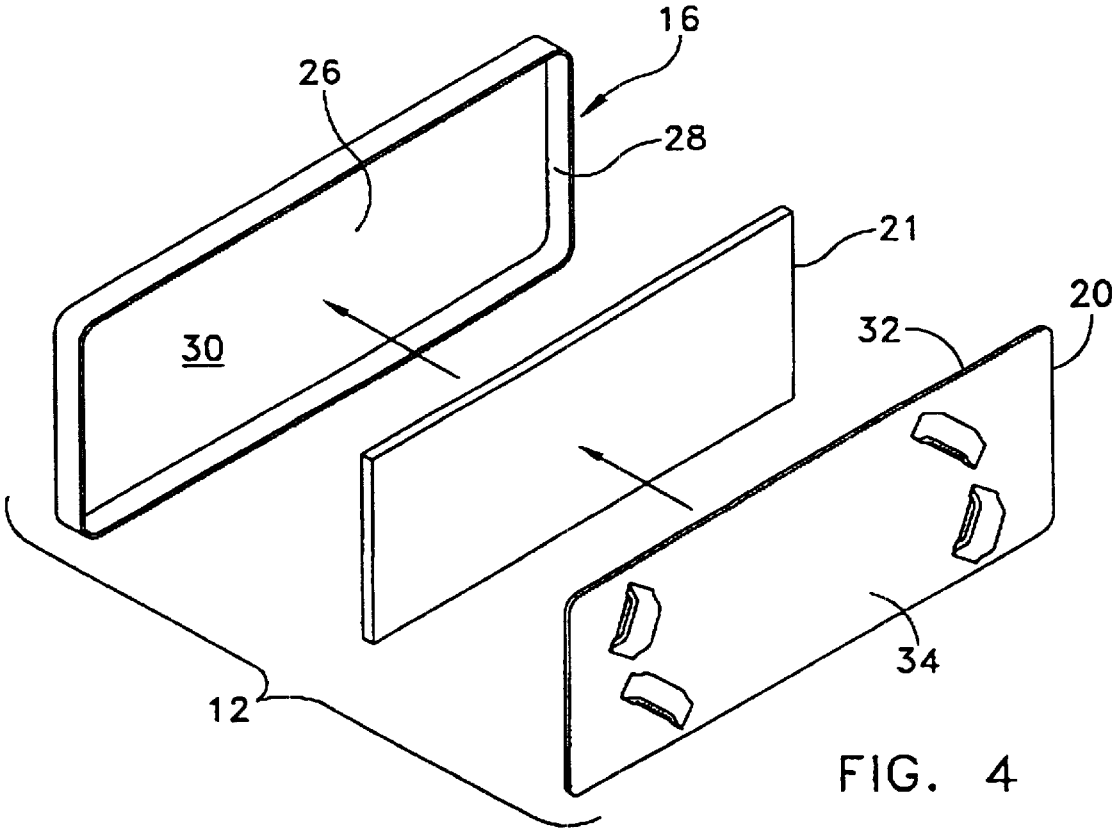
FIG. 4 is an exploded view of the name plate assembly of FIG. 1.
Figure 8:
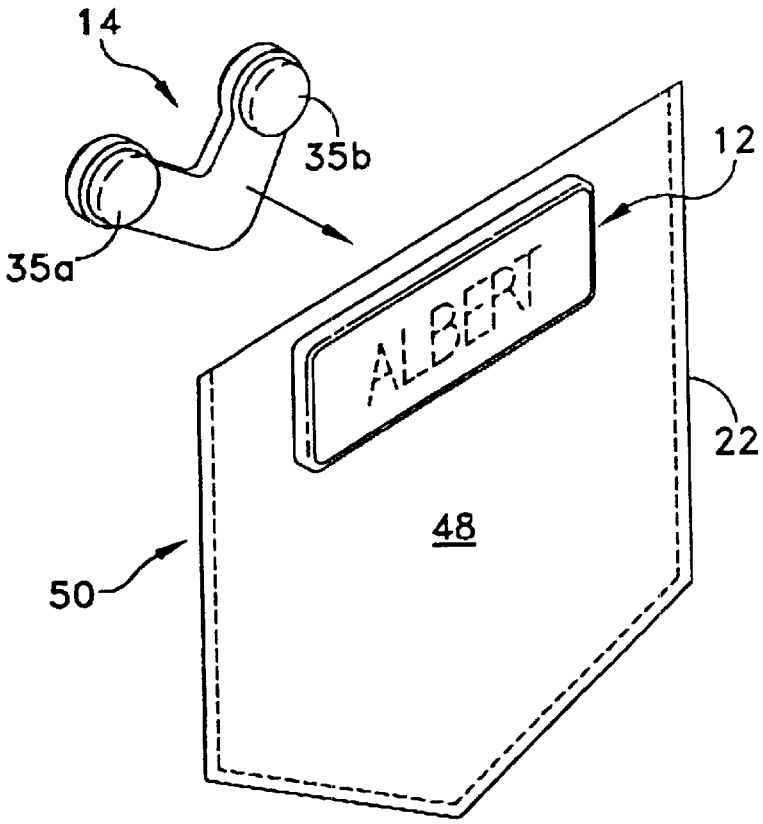
FIG. 8 is a perspective view showing the name plate assembly being engaged with an article of clothing.
Figure 9:
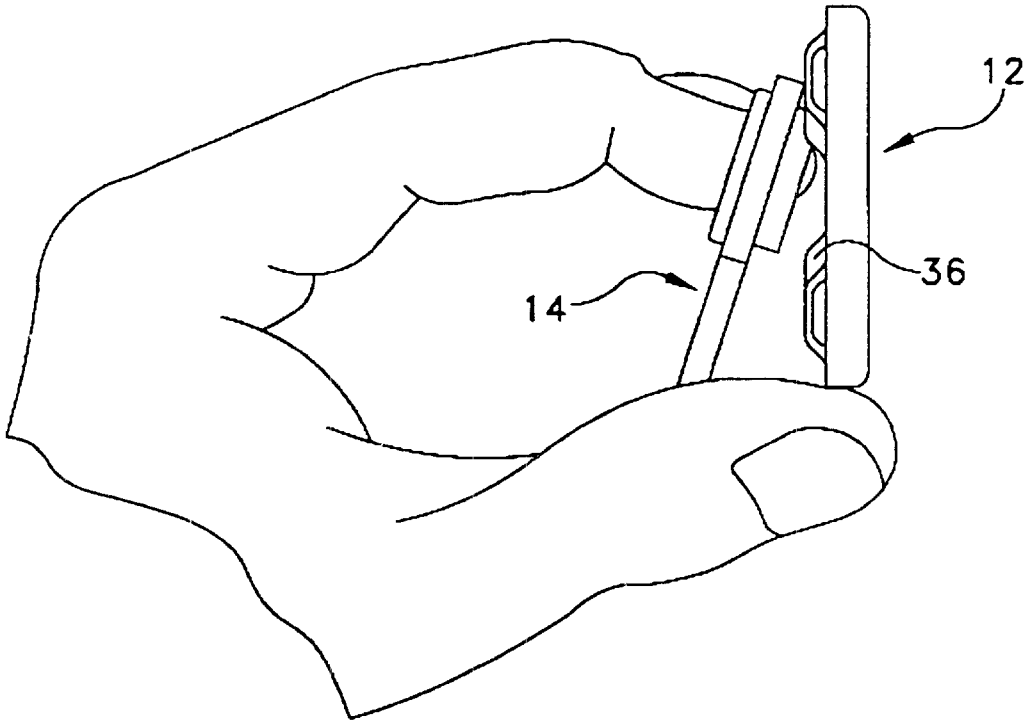
FIG. 9 is a schematic view showing the connector being removed from engagement with the name plate by a user.

The name plate preferably includes a face plate 16 for displaying indicia, such as a user's name 18, and a back plate 20 which is adapted to engage the article of clothing 22 (FIG. 8). The face plate 16 may be attached to the back plate 20 by adhesive, for example a strip of double sided adhesive tape 21. In the present embodiment, the face plate preferably includes a front surface 24 and a rear surface 26, with a lip 28 extending from the front surface and around a perimeter of the face plate. The lip defines a recess 30 for receiving the adhesive tape 21 and back plate 20 therein (FIG. 4). The back plate 20 is sized to fit within recess 30 and includes a first or inner surface 32 for connection to the face plate by the adhesive, and a second or outer surface 34 adapted to engage the article of clothing 22. The outer surface of the back plate 20 is placed in a facing relationship with the connector 14 during use, such that the article of clothing is sandwiched between the back plate and the connector 14. The back plate 20 is preferably made of a magnetically conductive material such that magnets 35*a, b* disposed in connector 14 are attracted to the back plate 20 in order to hold the name plate assembly to the clothing. The back plate may also preferably include a recess (not shown) or a set of protrusions 36 in order to limit movement of the name plate assembly and connector 14 relative to each other. In the present embodiment, there are two sets of two generally rectangular protrusions each, which are supported on and extend from the back plate 20. The number and size of the protrusions may vary, or there may be no protrusions, as would be known to those of skill in the art. The face plate 16 and back plate 20 may be generally flat and rectangular in shape, although other shapes, sizes and configurations may be utilized as would be known to one of skill in the art. In addition, although shown as separate pieces, the name plate 12 may be formed as a single, unitary member.

Figure 5:
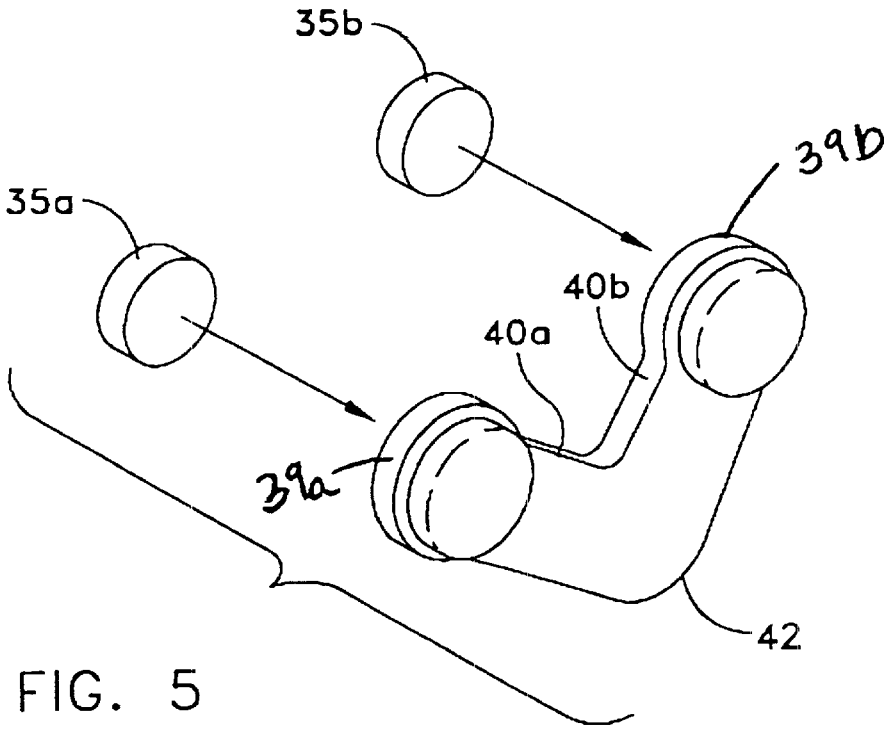
FIG. 5 is a perspective view of the connector of the name plate assembly of FIG. 1 with magnets removed.
Figure 6:
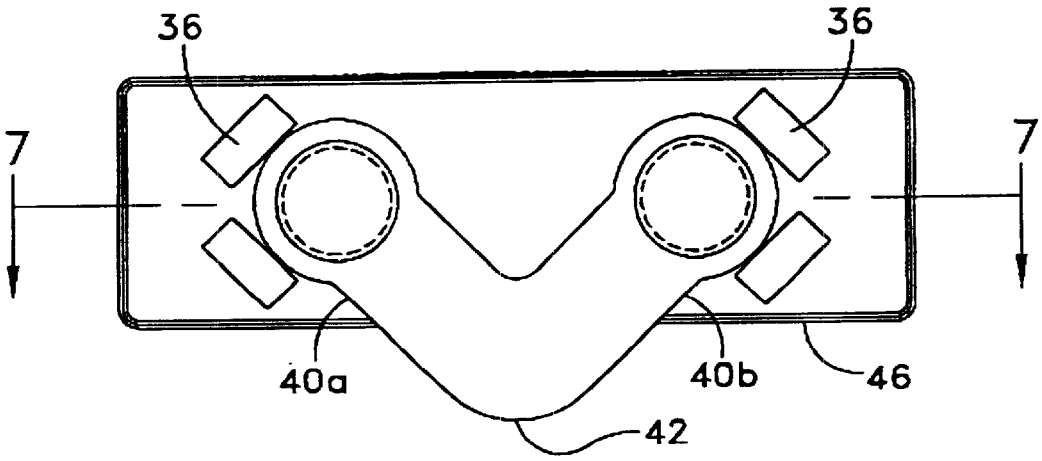
FIG. 6 is a rear plan view of the name plate assembly of FIG. 1 with the name plate and connector in engagement.
Figure 7:
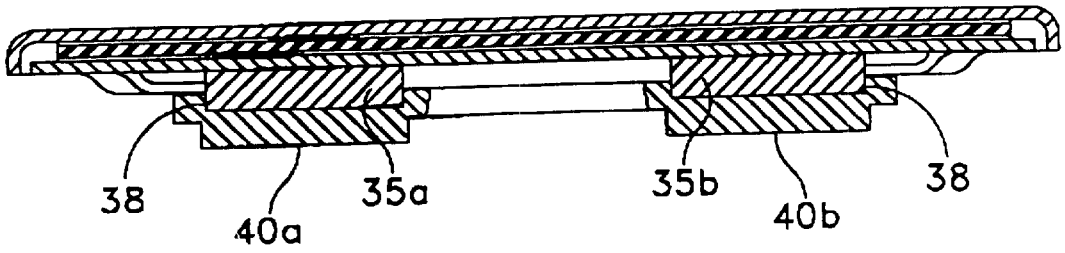
FIG. 7 is a cross-sectional view of the name plate assembly of FIG. 1 taken along lines 7—7 of FIG. 6.

Referring to FIGS. 5 and 6, connector 14 has a first portion 42 which extends beyond an edge 46 of the name plate, the first portion being sized to be gripped by the fingers of a user. In the present embodiment, the connector may preferably be V-shaped, including a pair of legs 40*a, b* and an apex 42 connecting the legs. When the name plate assembly is attached to the article of clothing during use, the apex of the connector preferably extends below either a lower edge or upper edge of the name plate assembly. As the first portion 42 is engaged by the user, such as by pushing or pulling, the connector 14 acts as a lever in order to disengage the connector 14 from the name plate 12 (which acts as a fulcrum), as described in greater detail below. The connector may also preferably include a pair of indentations 38 (FIG. 7) in a first side 39 of the connector, the indentations being disposed on either end 39*a, b* of legs 40*a, b,* respectively, in order to receive magnets 35*a, b* therein. The first side containing the magnets is preferably disposed in facing relation with the back plate during use such that the article of clothing is sandwiched therebetween, and the nameplate is secured in place by the magnetic attraction between the magnets and the back plate.

The connector 14 may preferably be made of a conductive material, such as metal, so that the magnets 35*a, b* can be held in place by magnetic attraction, without the need for adhesives or the like. In order to prevent the magnets from falling out of the indentations, the conductive material from which the connector 14 is made is preferably sufficiently thicker than that of the back plate 20 to which the magnets are magnetically attracted, since the strength of magnetic attraction is directly related to the mass, or thickness, of the conductive material. The connector may preferably be about 25% (or more) thicker than the thickness of the backplate, and is most preferably about 33% thicker than that of the back plate, such that the back plate is sufficient to hold the name plate assembly firmly, but does not have enough attraction to pull the magnets out of the connector. In the present embodiment, the connector is made from 0.074 steel, while 0.025 steel is used for the back plate. Alternatively, the connector 14 may be made out of any material, and the magnets 35*a, b* may be held in place by adhesive or other mechanical connection. In the present embodiment, two circular-shaped magnets 35*a, b* are preferably provided although other shapes and number of magnets may be utilized, as would be known to one of skill in the art.

Figure 10:
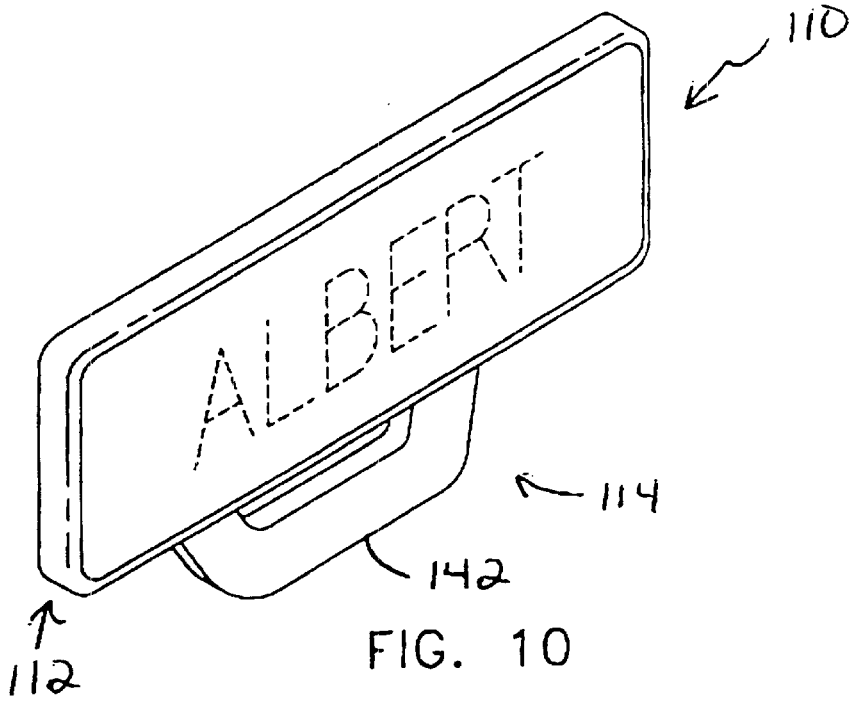
FIG. 10 is a front perspective view showing a magnetic name plate assembly in accordance with a second embodiment of the present invention.
Figure 11:
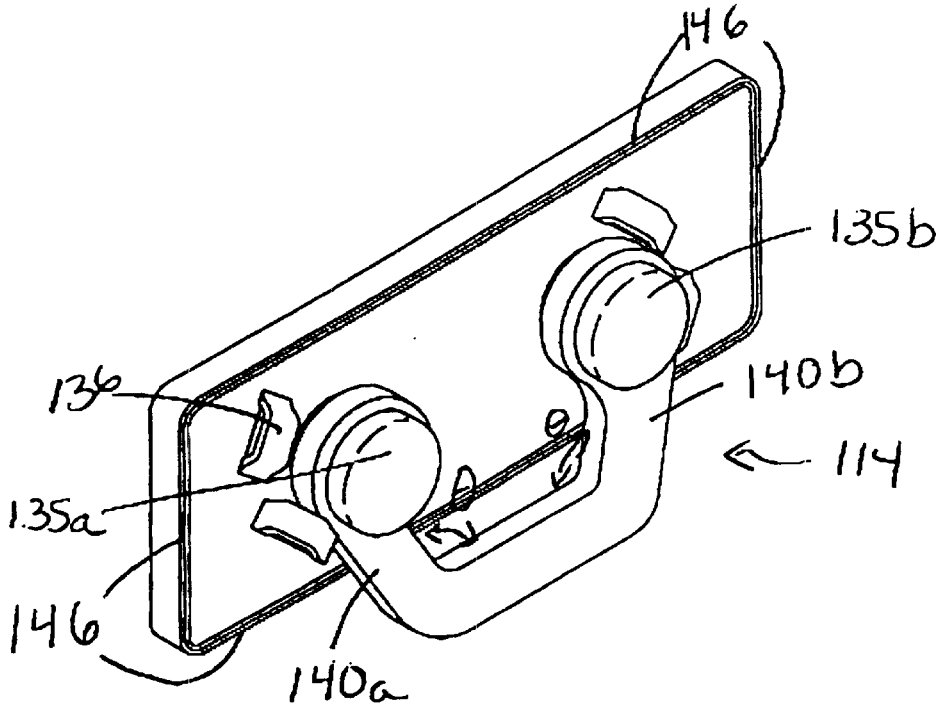
FIG. 11 is a rear perspective view of the name plate assembly of FIG. 10 with the name plate and connector in engagement.

Referring now to FIGS. 10–11, a second embodiment of the name plate assembly is illustrated. In this embodiment, all parts which are the same, or similar to, corresponding parts of the first embodiment are noted with the same two last numbers, but preceded by the numeral "1". Name plate assembly 110 includes a name plate 112 and a connector 114 which are magnetically attracted to each other. In this embodiment, the name plate 112 is substantially identical to the name plate described with respect to FIGS. 1–9. The connector 114 has been modified, such that connector 114 preferably has a generally "U-shape", with a first portion 142 of the "U" extending beyond an edge 146 of the name plate 112.

The connector 114 of the present embodiment also includes a pair of legs 140*a, b* which extend from the first portion 142 and which may be angled slightly outward from the first portion, i.e. at an angle θ greater than about 90 degrees. Alternately, the legs 140*a, b* may not be angled outward, but may extend at about 90 degrees or less from the first portion 142. When extending about 90 degrees from the first portion, the connector still has a generally "U" shape. However, at less than about 90 degrees, the connector begins to resemble a triangular shape. When the name plate assembly is attached to the article of clothing during use, the first portion 142 of the connector preferably extends below an edge of the name plate assembly, for example the upper or lower edge, as previously described. The first portion 142 is also sized to be gripped by the fingers of a user so that the user may grasp the first portion and by pushing or pulling force the connector from engagement with the name plate. In this manner, the connector 114 acts as a lever and the name plate 112 acts as a fulcrum, as also described herein above. The remaining portions of connector 114, such as magnets 135*a, b* are as described above with reference to the first embodiment of FIGS. 1–9.

Figure 12:
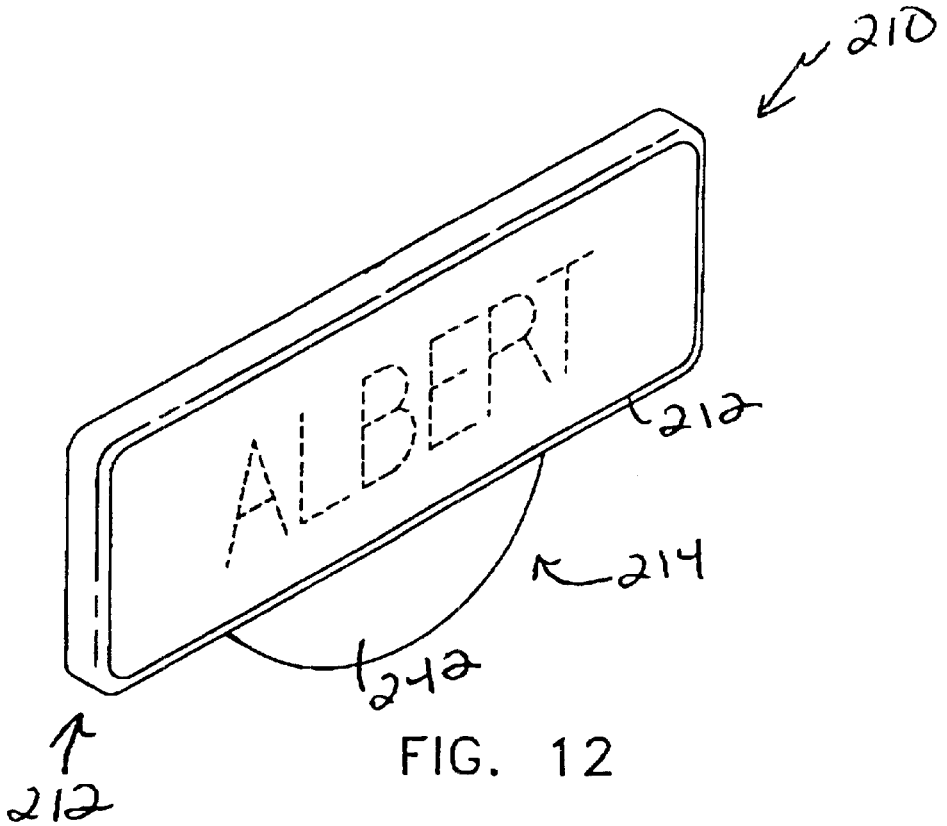
FIG. 12 is a front perspective view showing a magnetic name plate assembly in accordance with a third embodiment of the present invention.
Figure 13:
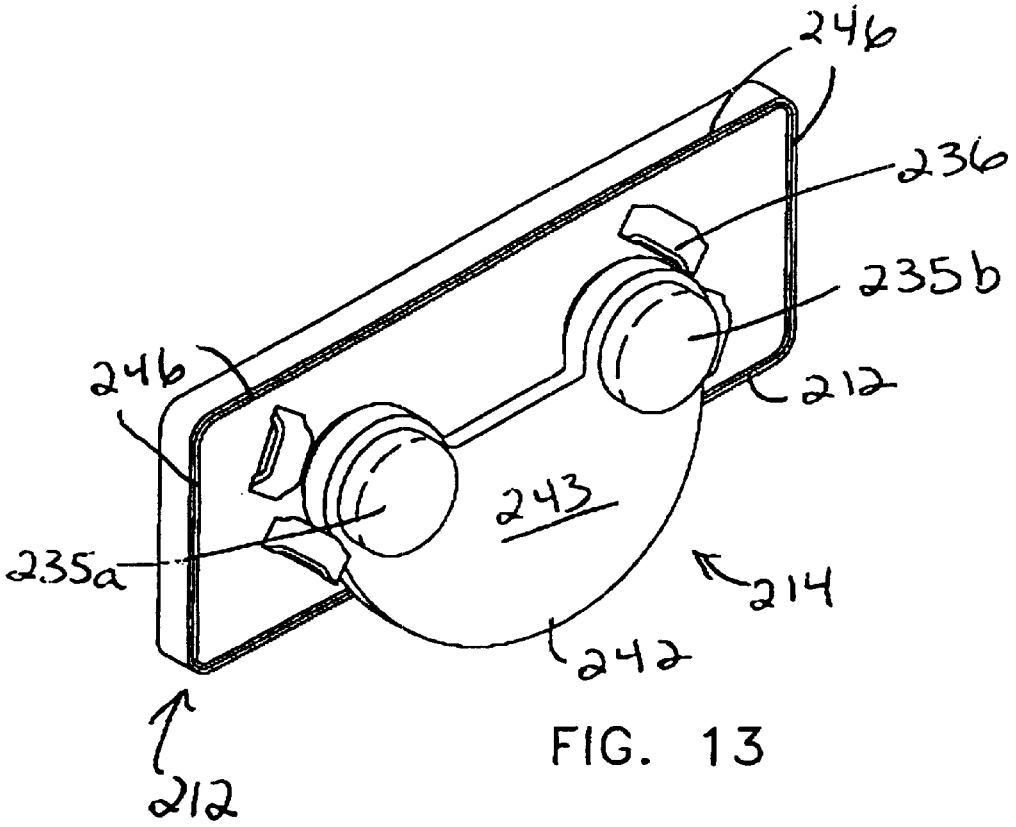
FIG. 13 is a rear perspective view of the name plate assembly of FIG. 12 with the name plate and connector in engagement.
Figure 14:
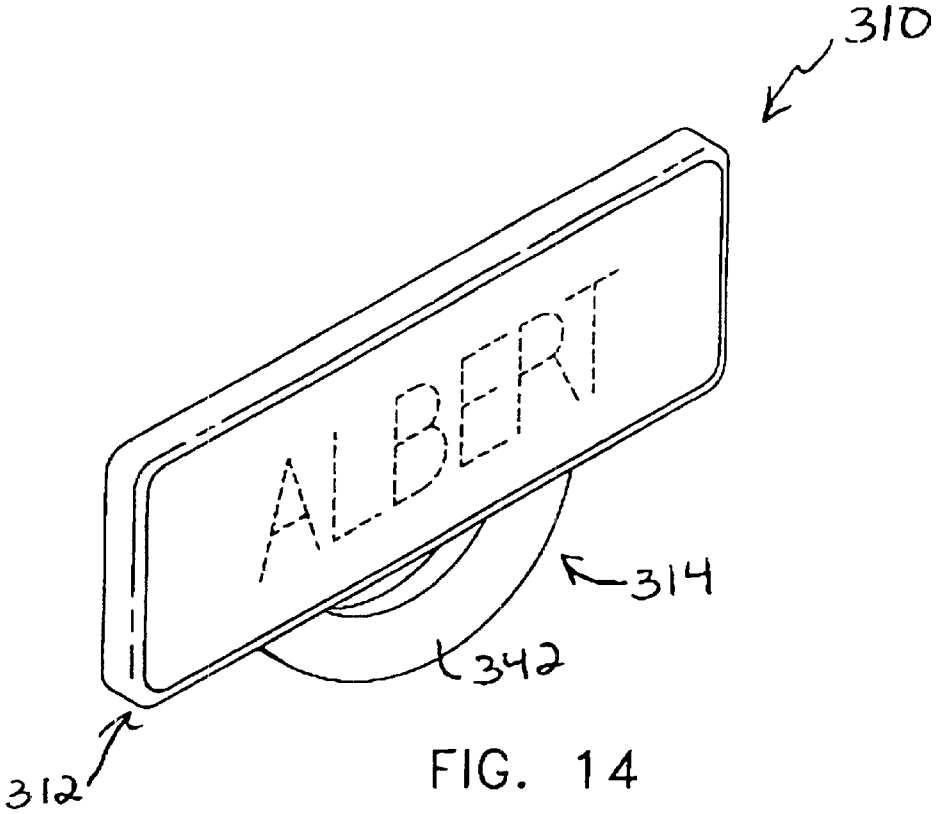
FIG. 14 is a front perspective view showing a magnetic name plate assembly in accordance with a fourth embodiment of the present invention.
Figure 15:
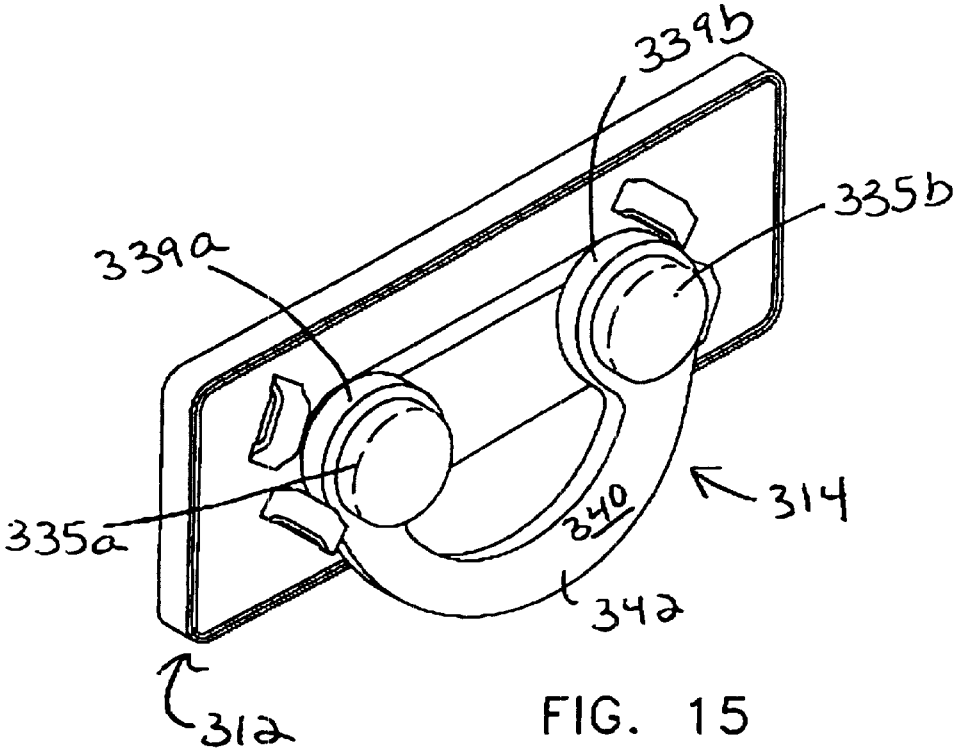
FIG. 15 is a rear perspective view of the name plate assembly of FIG. 14 with the name plate and connector in engagement.
Figure 16:
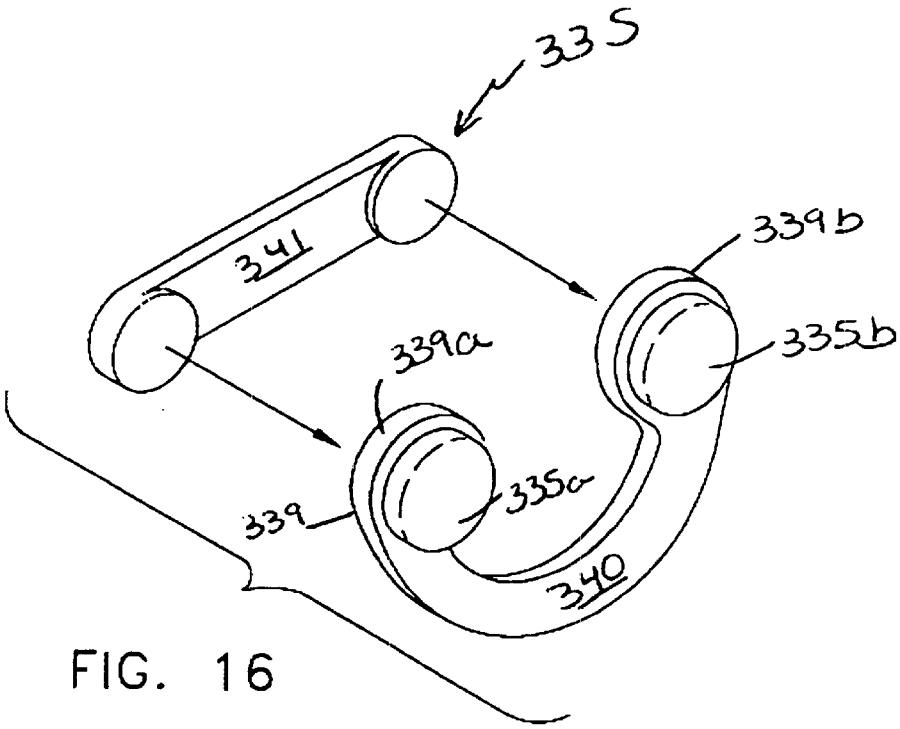
FIG. 16 is a perspective view of the connector of the name plate assembly of FIG. 14 with a magnetic assembly removed.
Figure 17:
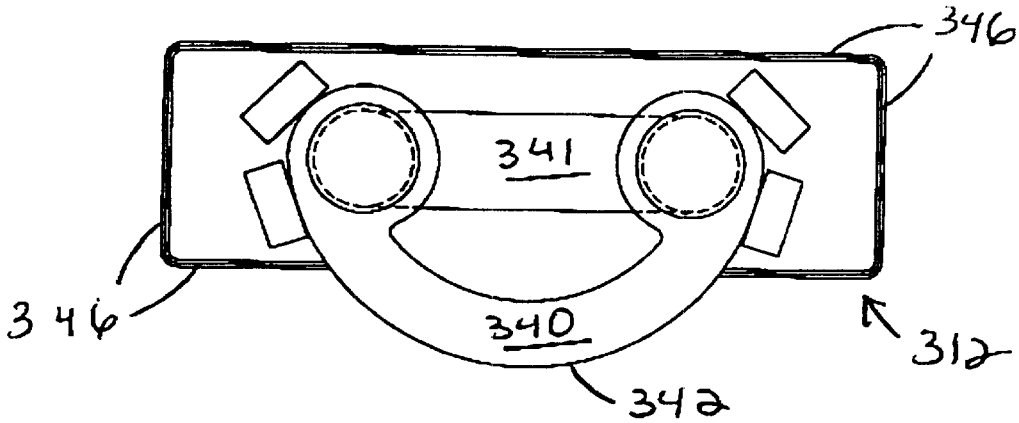
FIG. 17 is a rear plan view of the name plate assembly of FIG. 14 with the name plate and connector in engagement.
Figure 18:
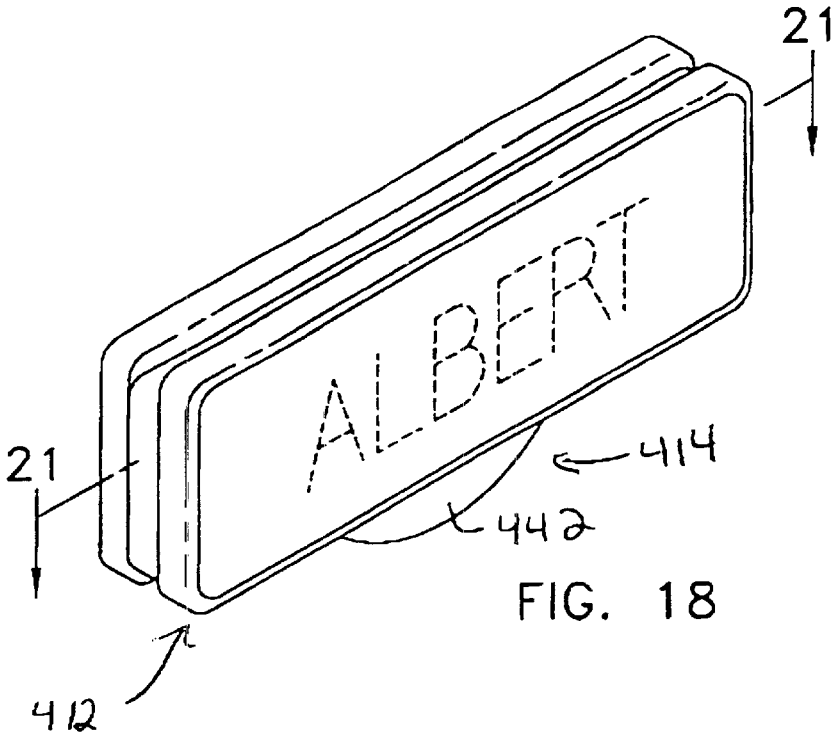
FIG. 18 is a front perspective view showing a magnetic name plate assembly in accordance with a fifth embodiment of the present invention in engagement.
Figure 19:
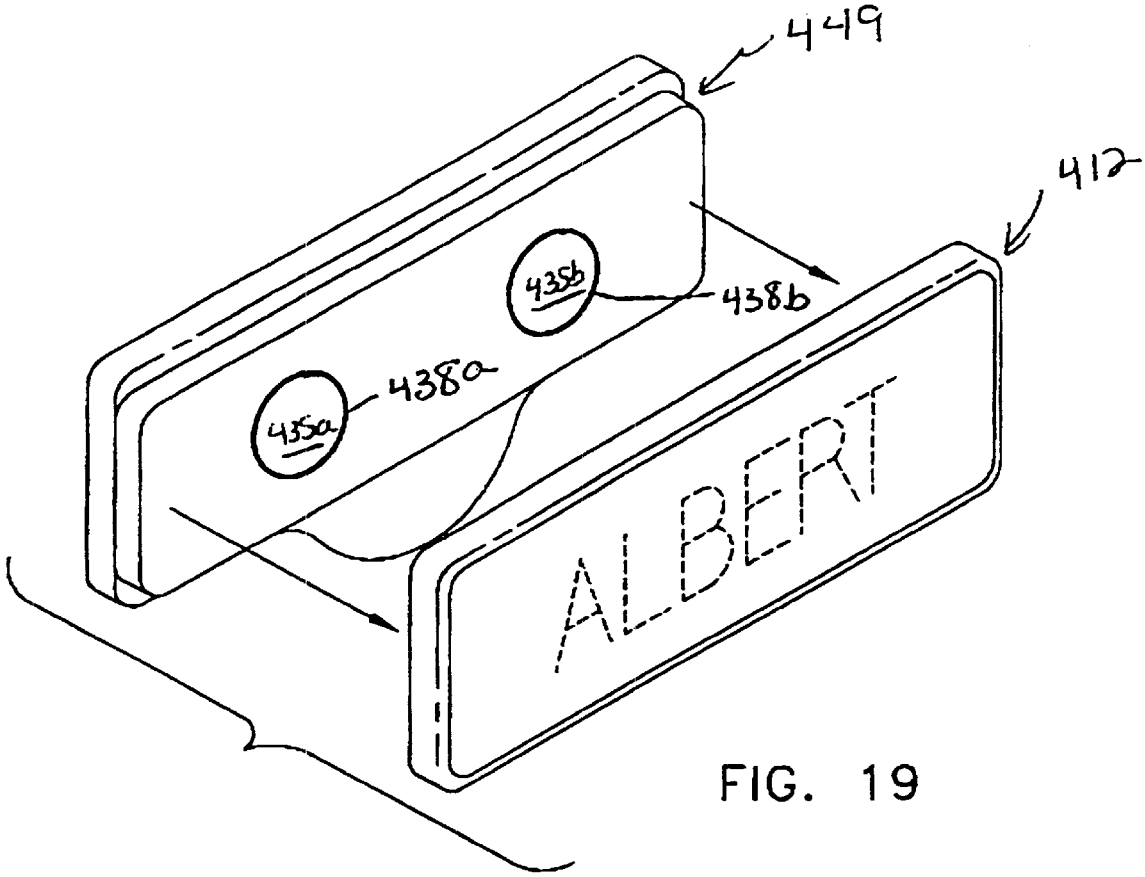
FIG. 19 is a front perspective view of the name plate assembly of FIG. 18 with the name plate and connector not in engagement.
Figure 20:
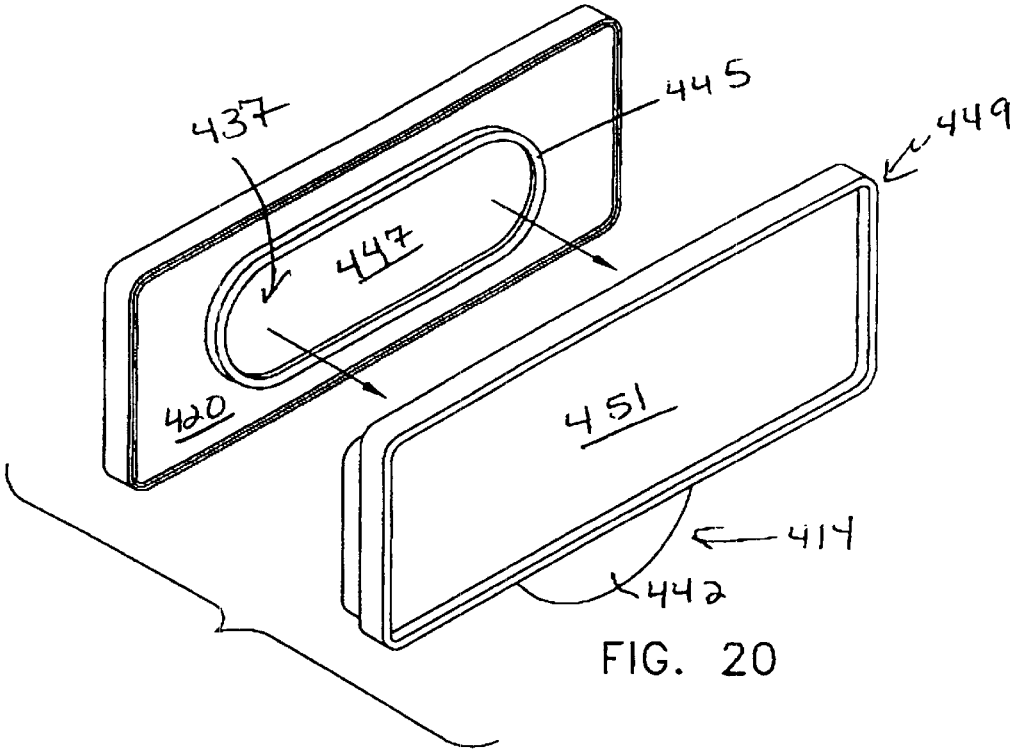
FIG. 20 is a rear perspective view of the name plate assembly of FIG. 18 with the name plate and connector not in engagement.
Figure 21:
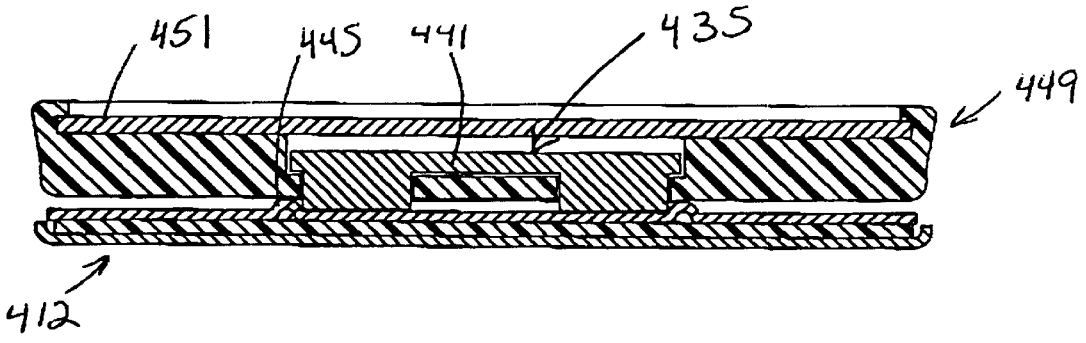
FIG. 21 is a cross-sectional view taken along lines 21—21 of FIG. 18.

Referring now to FIGS. 12–13, a third embodiment of the name plate assembly is illustrated. In this embodiment, all parts which are the same, or similar to, corresponding parts of the previous embodiments are noted with the same two last numbers, but preceded by the numeral "2". Name plate assembly 210 includes a name plate 212 and a connector 214 which are magnetically attracted to each other. In this embodiment, the name plate 212 is substantially identical to the name plate described with respect to FIGS. 1–9. The connector 214 has been modified, such that connector 214 preferably has a generally semi-circular shaped body, with a first portion 242 of the semi-circle extending beyond an edge 246 of the name plate 212. In the present embodiment, the semi-circular body has a generally solid, or continuous outer surface 243. Alternately, the outer surface may be non-continuous as shown in FIGS. 14–17. The first portion 242 is also sized to be gripped by the fingers of a user so that the user may grasp the first portion and by pushing or pulling force the connector from engagement with the name plate. In this manner, the connector 214 acts as a lever and the name plate 212 acts as a fulcrum, as also described herein above. The remaining portions of connector 214, such as magnets 235*a, b* are as described above with reference to the previous embodiments.

Referring now to FIGS. 14–17, a forth embodiment of the name plate assembly is illustrated. In this embodiment, all parts which are the same, or similar to, corresponding parts of the previous embodiments are noted with the same two last numbers, but preceded by the numeral "3". Name plate assembly 310 includes a name plate 312 and a connector 314 which are magnetically attracted to each other. In this embodiment, the name plate 312 is substantially identical to the name plate described with respect to FIGS. 1–9. The connector 314 has been modified, such that connector 314 preferably has a generally semi-circular shape, with a first portion 342 of the semi-circle extending beyond an edge 346 of the name plate 312. The magnets 335*a, b* may also be modified such that they are part of a magnet assembly 335.

In the present embodiment, the generally semi-circular shape of the connector is formed from a single, unitary leg 340 extending between either end 339*a, b* of the connector. The connector may also preferably include a pair of indentations or opening in a first side 339 of the connector, the indentations being disposed on either end 339*a, b* of the leg 340 in order to receive magnets 335*a, b* therein. The magnets may be preferably connected by a bridge or bar 341 as part of magnet assembly 335 in the present embodiment. The magnetic assembly may be a single, unitary member, or may be formed as separate pieces which are then joined. The first side containing the magnets is preferably disposed in facing relation with the back plate during use such that the article of clothing is sandwiched therebetween, and the nameplate is secured in place by the magnetic attraction between the magnets and the back plate as described herein above with respect to the first embodiment.

When the name plate assembly is attached to the article of clothing during use, the first portion 342 of the connector preferably extends below an edge 346 of the name plate assembly, as previously described. The first portion 342 is also sized to be gripped by the fingers of a user so that the user may grip the first portion and by pushing or pulling force the connector from engagement with the name plate. In this manner, the connector 314 acts as a lever and the name plate 312 acts as a fulcrum, as also described herein above.

Referring now to FIGS. 18–21, a fifth embodiment of the name plate assembly is illustrated. In this embodiment, all parts which are the same, or similar to, corresponding parts of the previous embodiments are noted with the same two last numbers, but preceded by the numeral "4". Name plate assembly 410 includes a name plate 412 and a connector 414 which are magnetically attracted to each other. Name plate 412 may be constructed as described above with respect to FIGS. 1–9. However, the name plate 412 preferably includes an enclosure 437 (FIG. 20) in place of protrusions, in order to guide and limit movement of the name plate assembly and connector 414 relative to each other. In the present embodiment, the enclosure 437 is generally oval and includes a raised wall 445 around the perimeter thereof. Alternately, the enclosure may have any shape and may be formed as a recess wherein the base 447 is recessed relative to the remaining portion of the back plate 420, as would be known to those of skill in the art.

The connector 414 has also been modified and preferably includes body portion 449 for supporting magnets 435*a, b* therein. A first portion 442 of the body portion 449 extends beyond an edge of the name plate 412 during use, as described above. The body portion 449 may preferably be non-conductive, and have a generally rectangular shape with the first portion 442 having a generally arcuate or semi-circular shape and extending from one edge of the rectangle. The rectangular shape may be sized to generally correspond to the shape and size of the name plate 412. Alternate shapes and sizes may be utilized as would be known to those of skill in the art.

The magnets 335*a, b* are preferably supported within the body portion 449 either individually, or as part of a magnet assembly 435. The magnets may be preferably connected by a bridge or bar 441 which can be enclosed with the body portion, with a first side of the magnets received through an pair of openings 438*a, b* in the body portion. The first side containing the magnets is preferably disposed in facing relation with the back plate 420 during use such that the article of clothing is sandwiched therebetween. The nameplate is secured in place by the magnetic attraction between the magnets and the back plate as described herein above with respect to the first embodiment. The magnets are preferably positioned within enclosure 437 such that movement of the back plate relative to the nameplate is restricted by raised wall 445 The magnetic assembly 435 may be a single, unitary member, or may be formed as separate pieces which are then joined. The body portion 449 is preferably made of a non-conductive material, such as plastic and the first portion 442 may have a generally arcuate or semi-circular shape. The body portion may also include a back surface 451 adapted to receive a label (not shown) which can contain printed indicia thereon. Alternately, the body portion may be made of a conductive material and the first portion 442 may have any of a number of shapes, provided that the first portion be sized to be gripped by a user so that the user may grasp the first portion and by pushing or pulling force the connector from engagement with the name plate. In this manner, the connector 414 acts as a lever and the name plate 412 acts as a fulcrum, as also described herein above.

Figure 22:
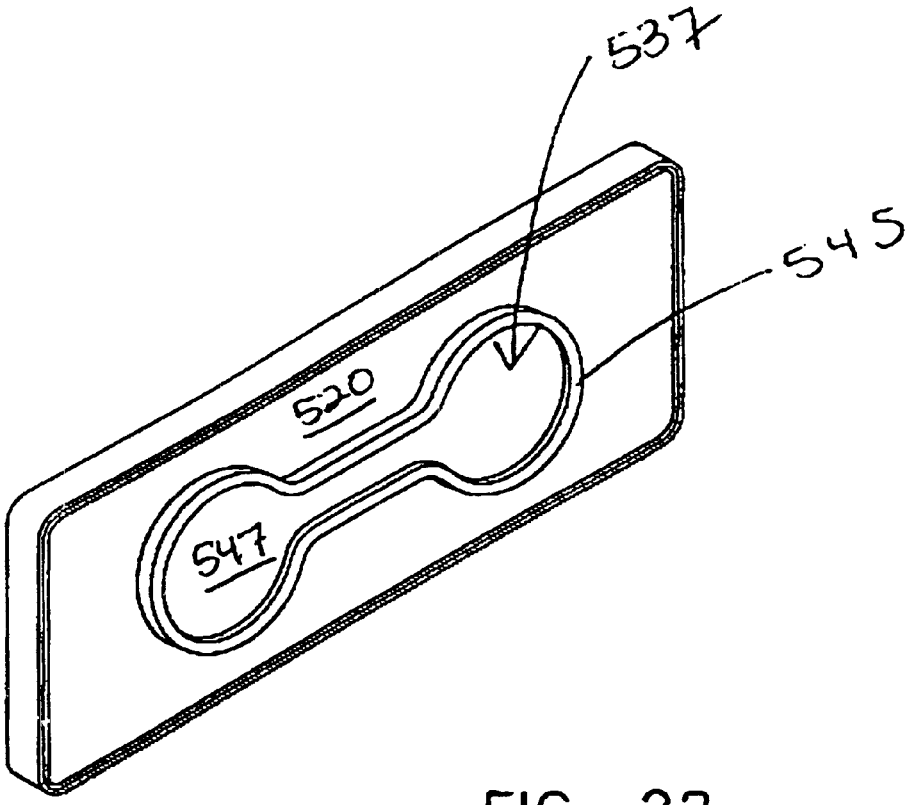
FIG. 22 is a rear perspective view of a name plate in accordance with a sixth embodiment of the invention.
Figure 23:
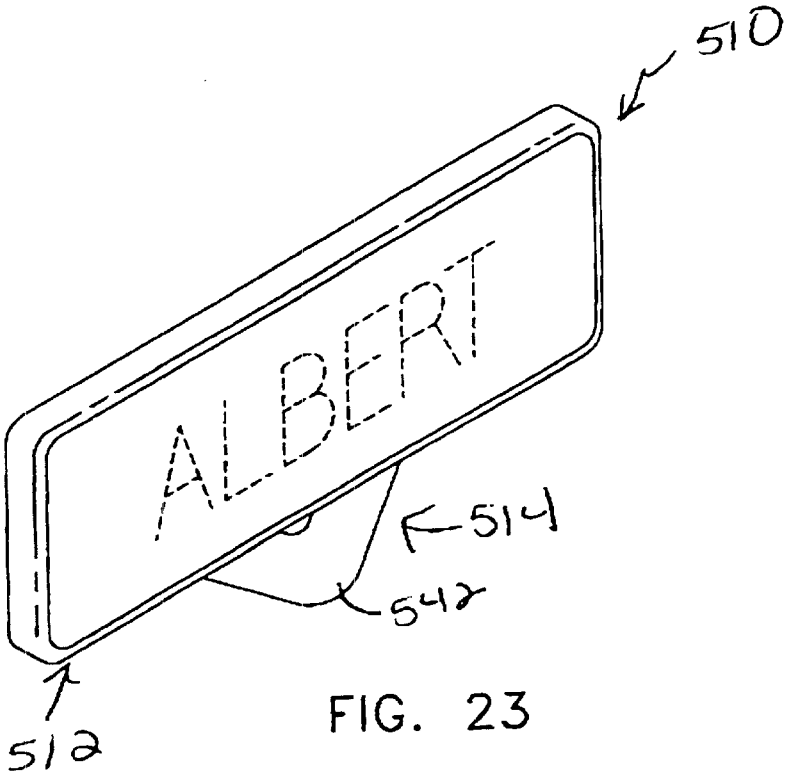
FIG. 23 is a front perspective view of the connector of FIG. 22 in engagement with an exemplary connector.
Figure 24:
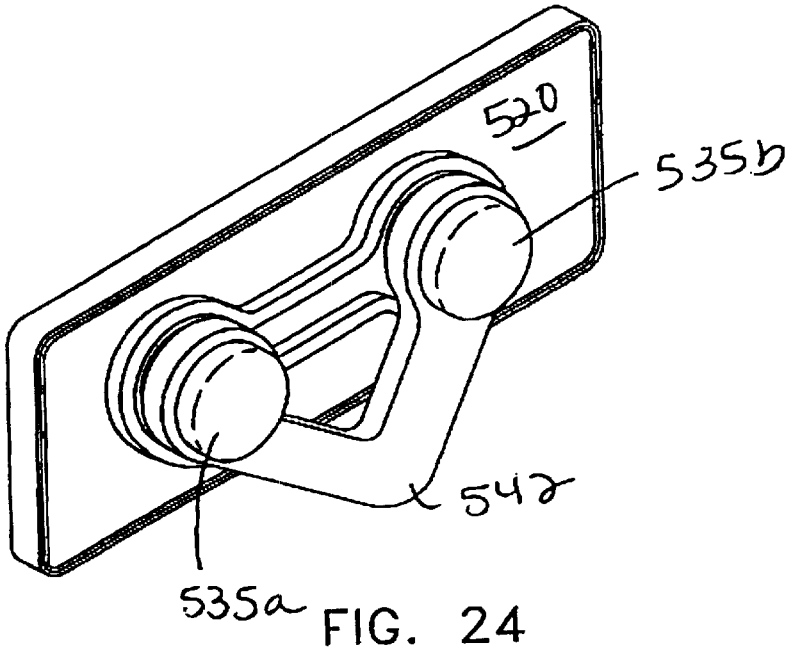
FIG. 24 is a rear perspective view of the connector of FIG. 22 in engagement with an exemplary connector.

Referring now to FIGS. 22–24, a sixth embodiment of the name plate assembly is illustrated. In this embodiment, all parts which are the same, or similar to, corresponding parts of the first embodiment are noted with the same two last numbers, but preceded by the numeral "5". Name plate assembly 510 includes a name plate 512 and a connector 514 which are magnetically attracted to each other. In this embodiment, the connector 514 is substantially identical to any of the connectors described herein above, but has been illustrated with the connector shown in FIGS. 1–9. The name plate 512 has been modified, to include an enclosure 537 in place of protrusions, in order to guide and limit movement of the name plate assembly and connector 514 relative to each other. In the present embodiment, the enclosure 537 has a generally bar-bell shape defined by a raised wall 545 around the perimeter thereof. Alternately, the enclosure may have any shape and may be formed as a recess wherein the base 547 is indented relative to the remaining portion of the back plate, as would be known to those of skill in the art. Magnets 535*a,* 535*b* are preferably disposed in facing relation with the back plate 520 during use such that the article of clothing is sandwiched therebetween, and the nameplate is secured in place by the magnetic attraction between the magnets and the back plate as described herein above with respect to the first embodiment. The magnets are preferably positioned within enclosure 537 such that movement of the back plate relative to the nameplate is restricted by raised wall 545. The operation of the connector 514 is the same as described above with reference to the first embodiment of FIGS. 1–9.

Figure 25:
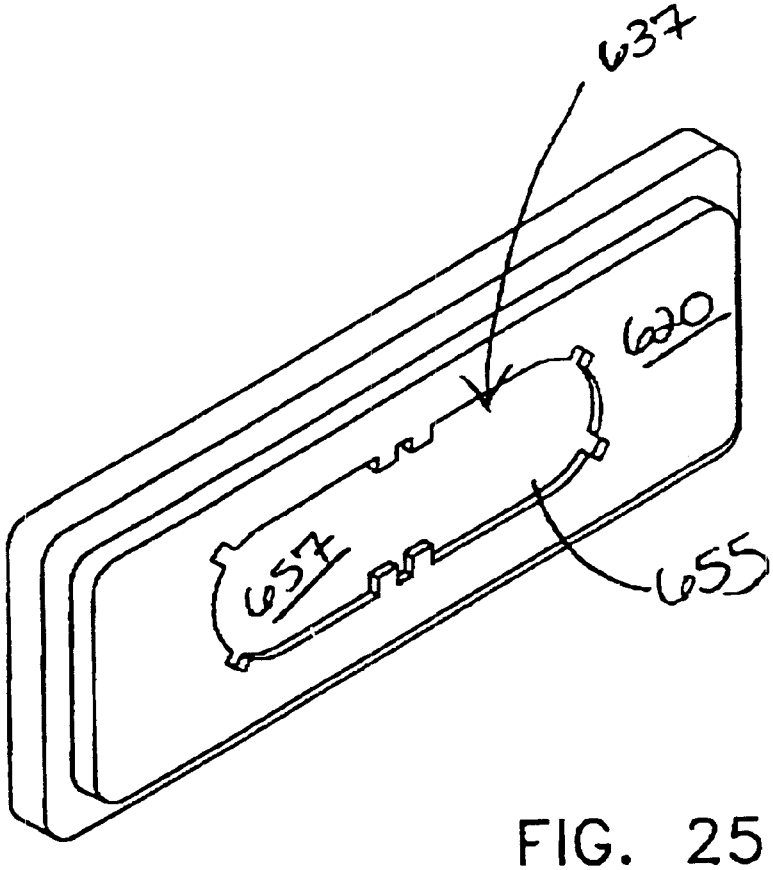
FIG. 25 is a rear perspective view of a name plate in accordance with a seventh embodiment of the invention.
Figure 26:
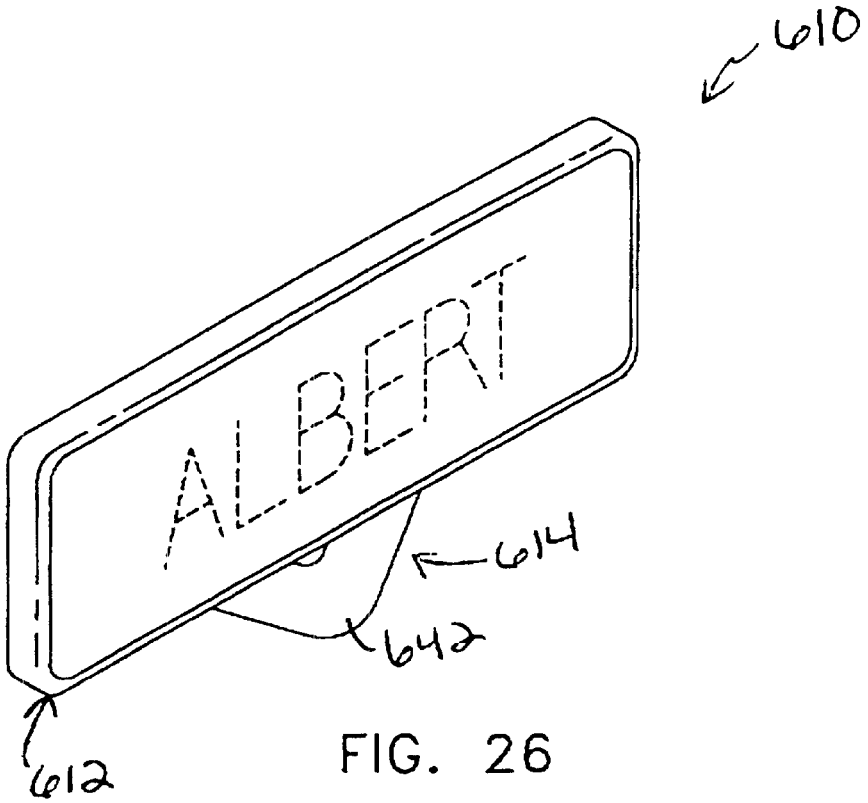
FIG. 26 is a front perspective view of the connector of FIG. 25 in engagement with an exemplary connector.
Figure 27:
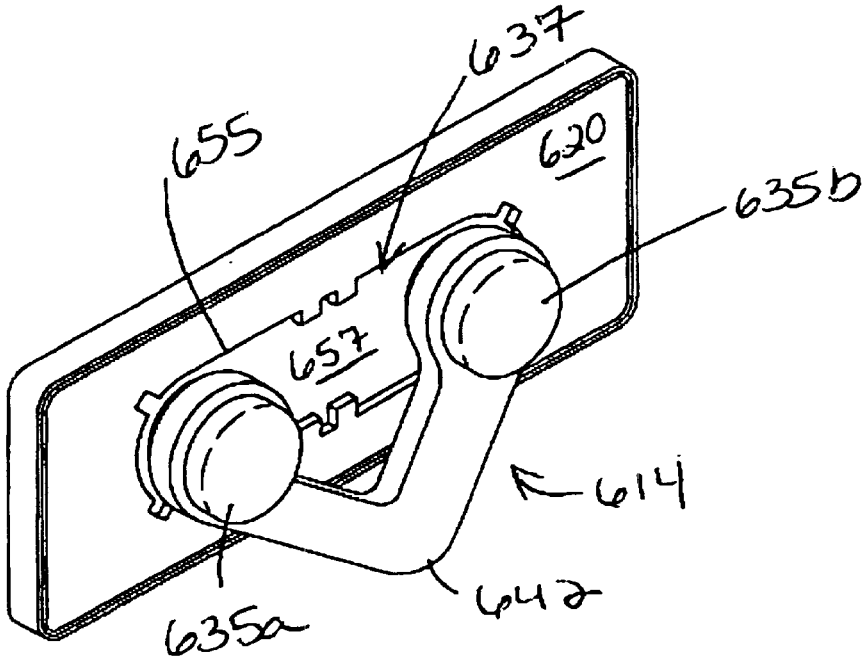
FIG. 27 is a rear perspective view of the connector of FIG. 25 in engagement with an exemplary connector.

Referring now to FIGS. 25–27, a seventh embodiment of the name plate assembly is illustrated. In this embodiment, all parts which are the same, or similar to, corresponding parts of the first embodiment are noted with the same two last numbers, but preceded by the numeral "6". Name plate assembly 610 includes a name plate 612 and a connector 614 which are magnetically attracted to each other. In this embodiment, the connector 614 is substantially identical to any of the connectors described herein above, but has been illustrated with the connector shown in FIGS. 10–11. The name plate 612 has been modified to include an enclosure 637 in place of protrusions, in order to guide and limit movement of the name plate assembly and connector 614 relative to each other. In the present embodiment, the enclosure 637 is in the form of a recess 655 having a generally oval shape. Alternately, the enclosure may have any shape, as would be known to those of skill in the art. In the present embodiment recess 655 may be formed by creating an opening through the back plate 620 and inserting a base 657 behind the opening. In order to secure the back plate to the connector, the base 657 may preferably be made of a conductive material.

The magnets are preferably disposed in facing relation with the back plate during use such that the article of clothing is sandwiched therebetween, and the nameplate 612 is secured in place by the magnetic attraction between the magnets and the back plate. The magnets are preferably positioned within recess 655 such that movement of the back plate relative to the nameplate is restricted by the recess. The operation of the connector 614 is the same as described above with reference to the second embodiment of FIGS. 10–11.

Use of the magnetic name plate assembly will now be described with continued reference to the figures.

In use, the user places the name plate 12 (112, 212, 312, 412, 512, 612) on an outer surface 48 of the article of clothing 22, for example pocket 50 (FIG. 8), such that the back plate engages the clothing's outer surface, and the face plate faces outward. The user then places the connector 14 (114, 214, 314, 414, 514, 614) against the inside surface of the clothing such that the magnets supported by the connector engage the clothing's inner surface, and are in facing relationship with the back plate. In this manner, part of the clothing is sandwiched between the name plate and connector in order to securely maintain the name plate to the clothing. The magnets may preferably be placed such that they lie between protrusions which act as a stop in order to limit movement of the name plate assembly and connector relative to each other, and to provide a guide for proper placement of the connector. Alternately, the magnets may be received within an enclosure (for example a recess) in the back plate which also act to limit movement and guide the magnets. Once the name plate and connector are properly positioned, the magnetic force between the magnets disposed in the connector and the back plate operates to securely maintain the name plate assembly to the article of clothing.

In order to remove the name plate assembly, the user may press on a first portion of the connector through the fabric, may grasp and pull on the connector, may place their finger beneath the first portion and push on the connector while holding the connector (FIG. 9), or may otherwise engage and apply a force to the first portion of the connector. In any case, the first portion of the connector extends beyond an edge of the back plate and acts as a lever in order to break the magnetic connection between the name plate and the connector so that the name plate assembly may be easily removed from engagement with the article of clothing without excessive force. In this manner, the name plate assembly can be easily removed by the user without injuring the article of clothing, or the user (for example the user's finger or nail).

It will be understood that various modifications may be made to the embodiment disclosed herein. For example, the shape, size and dimension of the elements described herein are not to be construed as limiting, but only as examples, as would be known to one of skill in the art. In addition, the connector may have an alternate shape, as long as the connector is capable of acting as a lever in order to break the magnetic connection between the connector and the name plate. The elements described herein may also be made of a variety of materials, provided that the connector is magnetically attracted to the back plate in order to hold the name plate assembly in engagement with the article of clothing, for example, the back plate may include a magnet in addition to, or instead of the connector. Therefore, the above description should not be construed as limiting, but merely as exemplifications of a preferred embodiment. Those skilled in the art will envision other modifications within the scope spirit of the invention.

What is claimed is:

1. In a magnetic name plate assembly including at least one magnetic member for attachment to an article of clothing, the name plate assembly including a name plate having a front surface adapted to display indicia, and a back plate adapted to contact an outer portion of the clothing, the improvement comprising;

a connector constructed and arranged to be held in magnetic engagement with the name plate and including a first portion adapted to extend beyond a section of the at least one edge of the name plate, the section having a length less than a length of the at least one edge, the first portion being dimensioned to be grasped by a user, the connector further including a second portion adapted to be disposed adjacent the name plate; and wherein the user applies a sufficient force to the first portion of the connector, so as to pivot the connector about the second portion in order to disengage the connector from the name plate, the connector acting substantially as a lever when disengaging the connector from magnetic engagement with the name plate.

2. The improvement of claim 1, wherein the connector has a shape selected from the group consisting of: a generally V-shape including a first and a second leg, and an apex connecting the first and second legs; a generally U-shape including a pair of legs which extend from the first portion; a generally semi-circular shape including a continuous outer surface; a generally semi-circular shape including a single, unitary leg extending between either end of the connector; and a generally rectangular shape body including a generally arcuate or semi-circular shape extending from one edge of the rectangular shape.

3. The improvement of claim 1, wherein the connector includes at least one indentation constructed and arranged to support a magnet therein.

4. The improvement of claim 1, in combination with a magnetic assembly.

5. The improvement of claim 1, wherein the first portion extends beyond one of an upper edge or lower edge of the back plate.

6. The name plate assembly of claim 1, wherein the section is substantially centered on the length of the edge so that the first portion of the connector extends beyond a central portion of the edge.

7. A connector constructed and arranged to be held in magnetic engagement with a name plate by a magnetic member supported on one of the connector or the name plate, the connector comprising:

a first side adapted to contact an inner portion of an article of clothing such that a portion of the clothing is sandwiched between the name plate and the connector during use;

a first portion constructed and arranged to extend beyond an edge of the name plate during use and sized to be grasped by a user;

wherein the connector has a shape selected from the group consisting of: a generally V-shape including a first and a second leg, and an apex connecting the first and second legs; a generally U-shape including a pair of legs which extend from the first portion; a generally semi-circular shape including a continuous outer surface; a generally semi-circular shape including a single, unitary leg extending between either end of the connector; and a generally rectangular shape body including a generally arcuate or semi-circular shape extending from one edge of the rectangular shape, and wherein to disengage the connector from the name plate, the first portion is grasped and a sufficient force is applied by a user such that the connector acts substantially as a lever in order to disengage the connector from magnetic engagement with the name plate.

8. The connector of claim 7, in combination with the name plate, the name plate further having a back plate adapted to magnetically engage the connector.

9. The connector of claim 8, wherein the back plate includes at least one protrusion constructed and arranged to limit the movement of the connector when the connector is magnetically engaged with the back plate.

10. The connector of claim 8, wherein the back plate includes an enclosure constructed and arranged to limit the movement of the connector when the connector is magnetically engaged with the back plate.

11. The connector of claim 10, wherein the enclosure is defined by a raised wall extending along a portion of the back plate.

12. The connector of claim 10, wherein the enclosure is defined by a recess in the back plate.

13. The connector of claim 7, in combination with at least one magnet.

14. The connector of claim 13, wherein the connector includes at least one indentation constructed and arranged to support the at least one magnet therein.

15. The connector of claim 14, wherein the connector is made of a conductive material such that the at least one magnet is held within the at least one indentation by magnetic attraction.

16. The connector of claim 13, wherein the at least one magnet is a magnetic assembly including a pair of magnets connected by a bridge.

17. The connector of claim 16, wherein the magnetic assembly is supported within a non-conductive body portion of the connector.

18. The connector of claim 7, wherein the first portion extends beyond one of an upper edge or lower edge of the back plate.

19. A magnetic name plate assembly for attachment to an article of clothing comprising:

a name plate including a front surface adapted to display indicia, a rear surface opposite the front surface, and at least one edge having a length;

a connector including a first side adapted to be held in magnetic engagement with the name plate, a first portion adapted to extend beyond a section of the at least one edge of the name plate, the section having a length less than the length of the at least one edge, the first portion being dimensioned to be grasped by a user;

wherein at least the connector or the name plate includes a magnetic member such that the connector and name plate are held in magnetic engagement during use; and wherein to disengage the connector from the name plate a user grips the connector at the first portion which extends beyond the section of the at least one edge, and applies a sufficient force to the first portion so as to disengage the connector from the name plate, the connector acting substantially as a lever when disengaging the connector from magnetic engagement with the name plate.

20. The name plate assembly of claim 19, wherein the section is substantially centered on the length of the edge so that the first portion of the connector extends beyond a central portion of the edge.

* * * * *